US006371609B1

(12) United States Patent
Oikawa

(10) Patent No.: US 6,371,609 B1
(45) Date of Patent: Apr. 16, 2002

(54) RECORDING APPARATUS AND A RECORDING METHOD

(75) Inventor: Masaki Oikawa, Kodaira (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/224,840

(22) Filed: Dec. 31, 1998

(30) Foreign Application Priority Data

Jan. 9, 1998 (JP) ..... 10-003225

(51) Int. Cl.[7] ..... B41J 2/17

(52) U.S. Cl. ..... 347/96; 347/19; 347/40; 347/41

(58) Field of Search ..... 347/96, 19, 40, 347/41

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,675,696 A | * | 6/1987 | Suzuki | 347/19 |
| 4,723,129 A | | 2/1988 | Endo et al. | |
| 4,740,796 A | | 4/1988 | Endo et al. | |
| 6,039,433 A | * | 3/2000 | Kobayashi et al. | 347/40 |
| 6,109,722 A | * | 8/2000 | Underwood et al. | 347/19 |

FOREIGN PATENT DOCUMENTS

| | | | |
|---|---|---|---|
| EP | 0699535 A2 * | 6/1996 | B41J/2/205 |
| JP | 54-56847 | 5/1979 | |
| JP | 59123670 | 7/1984 | |
| JP | 59-138461 | 8/1984 | |
| JP | 60-71260 | 4/1985 | |

* cited by examiner

*Primary Examiner*—John Barlow
*Assistant Examiner*—Manish S. Shah
(74) *Attorney, Agent, or Firm*—Fitzpatrick, Cella, Harper & Scinto

(57) ABSTRACT

A recording apparatus and a recording method for controlling and driving a recording head so that an image region formed by a first ink is located between alternate image regions formed by a second ink and that the ends of a region onto which a liquid is ejected are located with substantially the same interval as the end-to-end interval of the image region of the first ink, and are shifted to a plurality of locations. A plurality of timings of ejecting the liquid corresponding to the plurality of locations are stored in a memory device. Of these timings an optimum one is selected and input according to the result of recording and then the liquid is ejected at the optimum timing during recording. This ensures that even when plain paper is used as the recording medium, the liquid is ejected at the optimum timing at those positions in a boundary area between the ends of the image region of the first ink and the alternate image regions of the second ink which do not result in bleeding of the first and second inks. Hence, the adjustment of the ejection positions of the liquid and the first and second inks can easily be made.

23 Claims, 7 Drawing Sheets

LANDING POSITION ADJUSTING PATTERN

MISALIGNMENT OF LANDING POSITION

ALIGNMENT OF LANDING POSITION

RECORDING APPARATUS AND A RECORDING METHOD

This application is based on Patent Application No. 10-3225 (1998) filed Jan. 9, 1998 in Japan, the content of which is incorporated hereinto by reference.

BACKGROUND OF THE INVENTION

Field of the Invention

The present invention relates to a recording apparatus and a recording method and more particularly to a recording apparatus and a recording method that eject ink droplets towards a recording medium to perform recording.

An ink-jet printer has been available which shoots droplets of recording liquids from orifices formed at the front ends of liquid-flow-paths of nozzles to perform recording.

When the ink-jet printer prints(records) on normal plain paper, the recording liquids (inks) spread or wick, a problem caused by fibers of paper. In recent years, to make a high-quality recorded image, a method has been adopted which ejects a processing liquid for recording(hereinafter referred to simply as a processing liquid) onto the recording medium immediately before or after the recording liquid is ejected. The processing liquid ejected immediately before the printing operation is also called a "pre-ejection" liquid. The processing liquid is transparent and colorless. The processing liquid and the recording liquid are ejected onto the same dot position on the recording medium to overlie each other. The two liquids are mixed on the recording medium and react with each other to be stabilized on the recording medium before they can spread into the recording medium.

Performing the above described recording method can improve the recording liquid's ability to develop color on the recording medium and resist water, and can reduce spreading (or bleeding) thus enhancing the recording performance. The improvement in the recording performance through the use of the processing liquid is significant particularly when normal plain paper without any coating over an ink accepting layer is used as a recording medium.

Referring to FIG. 1, the outline of how the processing liquid is ejected in the prior art will be described.

In FIG. 1, recording is performed by scanning of a recording head 2 over a recording paper 6 in the direction of arrow. The recording head 2 has two lines of nozzle 1*a*, 1*b* spaced from each other by a distance d in the scanning direction, with the line of nozzle 1*a* ejecting an ink and the line of nozzle 1*b* ejecting a processing liquid. In each of the lines of nozzle 1*a*, 1*b* the orifices are arranged with intervals p (nozzle pitch).

When the recording head 2 starts scanning, the line of nozzle 1*b* ejects the processing liquid to form dots 4*b* on the paper 6. Next, the line of nozzle 1*a* ejects an ink to form dots 4*a*. When the scanning direction is opposite to the arrow, the above ejection sequence is reversed. The processing liquid is transparent and colorless and the dots of the processing liquid formed cannot actually be seen as illustrated in FIG. 1.

With the above operation performed, the processing liquid prevents the ink from spreading at a boundary 3 between a recorded region 5 and an unrecorded region 5*a* and at the same time improves the water-resisting and color development capabilities.

According to the results of experiments conducted by using the recording head 2 that the applicant of the invention has developed for ejecting an ink and a processing liquid, it is confirmed that the processing liquid does not need to be delivered for all ink dots, but needs only to be used for about 50% of the ink dots to produce a sufficient effect of the processing liquid. To prevent a waste of the processing liquid, a method is currently employed which sets the ejection ratio of the processing liquid dots to all of the ink dots at, for example, 50% during recording. This ejection ratio of the processing liquid (or a thinning ratio) should preferably be changed according to the volume of each droplet of ink and processing liquid ejected, the kind of ink (black ink and color inks), and the composition of the ink and the processing liquid.

To offer a capability of recording color images and photographic images, ink-jet printers are being developed which eject inks of a plurality of colors from a plurality of lines of nozzle. This type of printer also has provisions to precisely align the landing points of various color inks ejected from a plurality of lines of nozzle. To ensure that the landing points of different color inks agree correctly, a very high precision is required for the installation positions of the lines of nozzle, for the ink ejection speed, and for the paper-nozzle distance (distance between the nozzle surface and the surface of the recording medium), and these stringent requirements in turn cause a great deal of difficulty.

Even if the above high precision cannot be realized, recent printers employ an adjusting method (called a user head position adjusting method) which records a registration test pattern and allows the user to select an appropriate head adjusting position that has resulted in aligned landing points.

However, if an attempt is made to precisely match the landing points of ink and processing liquid with each other, this makes the problem even more difficult than when the above mentioned printer that aligns the landing points of different inks (the ink-jet printer that ejects a plurality of color inks from a plurality of lines of nozzle) is used. In addition to the very high precision required for the positions of the lines of nozzle, the ejection speed and the paper-nozzle distance, as described above, it is also necessary to eject the processing liquid immediately before or after the ink ejection. This makes it impossible to incorporate the ink nozzles and the processing liquid nozzles in the same line of nozzle. Further, because the ink and the processing liquid immediately solidify upon mixing, it is preferred that the line of nozzle for ink and the line of nozzle for processing liquid be spaced with a predetermined distance d in the scanning direction to prevent the ink and the processing liquid from mixing and solidifying and to differentiate the landing times of the ink and the processing liquid by a predetermined length of time.

While in recent years there is a trend toward a reduced nozzle pitch p, below approximately 50 $\mu$m, to meet demands for higher quality, the space d between lines of nozzle is large at around 10 mm. It is, however, difficult to increase the precision of the line of nozzle interval d to the level of nozzle pitch p because of the adopted manufacturing method, and any improvement in the line of nozzle interval precision will lead to increased cost. Although there is a method of fabricating two lines of nozzle separately and then assembling them together, improving the precision is all the more difficult with this method.

As described above, the user head position adjusting method cannot be used with plain paper because the processing liquid is transparent and colorless. With the head position adjusting method, one is required to use a transparent sheet of film and hold it up to light to see the dots.

Because of its nuisance and expensive film, this method is not commonly used.

In improving the precision, it is a conventional practice to form the line of nozzle for processing liquid in the same head that has the line of nozzle for ejecting at least one kind of ink, and to minimize the interval d between the two lines of nozzle as practically as possible. The precision improvement, however, leads to increased cost because of the difficulty inherent in the above described manufacturing method.

Arranging the line of nozzle for the ink and the line of nozzle for processing liquid closer together, gives rise to a problem that when the ink and the processing liquid land on the recording medium, rebounding splashes adhere to the orifices and forming mist. This problem may be dealt with by the use of a wiping means for wiping the orifices, however, which increases the cost. Reducing the nozzle pitch p to realize a higher print quality requires a further improvement in precision, which has reached the limit in the manufacturing method. The method of making individual lines of nozzle separately, is very difficult to implement and also reduces a degree of freedom in manufacturing.

As there are growing demands in recent years for printers with a higher print quality, an increased packing density of line of nozzle arrangement has become a very important issue. On the other hand, the ejection of the processing liquid is very important in improving the bleeding prevention, the water resistance and the color development, and a technique for effectively ejecting the processing liquid is increasingly called for.

SUMMARY OF THE INVENTION

Under these circumstances, the present invention has been accomplished to provide a recording apparatus and a recording method which perform recording by ejecting ink droplets against a recording medium, and which allows easy adjustment of the landing positions of the inks and the processing liquid even when plain paper is used as the recording medium.

To improve the above-mentioned object, the recording apparatus and method of the invention are presented. The recording apparatus comprises: a recording head having a first line of nozzle for ejecting a first ink, a second line of nozzle for ejecting a second ink and a third line of nozzle for ejecting a liquid that reacts with the first and second inks, the first, second and third lines of nozzle being arranged in substantially the same direction; a scanning means for moving the recording head in a predetermined direction different from the same direction to scan over a recording medium; a feeding means for feeding the recording medium in a direction substantially perpendicular to the predetermined direction; a recording means for driving the recording head to form an image on the recording medium under a control of an ink ejection control means and a control of a liquid ejection control means, the ink ejection control means controls ejection timings of the inks from the first and second lines of nozzle at predetermined timings so that an image region formed of the first ink on the recording medium is disposed between alternate image regions formed of the second ink, the liquid ejection control means controls ejection timings of the liquid from the third line of nozzle at predetermined timings so that ends of a ejection region of the liquid are located with substantially the same interval as an end-to-end interval of the image region and that the ejection region is shifted to a plurality of locations; a memory means for storing a plurality of ejection timings of the liquid that correspond to the plurality of locations; and a setting means for setting ejection timing of the liquid optimum, by entering some of the plurality of ejection timings to eject the liquid from the third line of nozzle, to eject the liquid to an area between the ends of the image region and the alternate image regions at which a bleeding of the first ink and the second ink can hardly result.

The recording method is one in a recording apparatus provided with: a recording head having a first line of nozzle for ejecting a first ink, a second line of nozzle for ejecting a second ink and a third line of nozzle for ejecting a liquid that reacts with the first and second inks, the first, second and third lines of nozzle being arranged in substantially the same direction; a scanning means for moving the recording head in a predetermined direction different from the same direction to scan over a recording medium; a feeding means for feeding the recording medium in a direction substantially perpendicular to the predetermined direction; the recording method comprising: a recording step of driving the recording head to form an image on the recording medium under a control of an ink ejection control means and a control of a liquid ejection control means, the ink ejection control means controls ejection timings of the inks from the first and second lines of nozzle at predetermined timings so that an image region formed of the first ink on the recording medium is disposed between alternate image regions formed of the second ink, the liquid ejection control means controls ejection timings of the liquid from the third line of nozzle at predetermined timings so that ends of a ejection region of the liquid are located with substantially the same interval as an end-to-end interval of the image region and that the ejection region is shifted to a plurality of locations; a memory step of storing a plurality of ejection timings of the liquid in a memory device, that correspond to the plurality of locations; and a setting step of setting ejection timing of the liquid optimum, by entering some of the plurality of ejection timings to eject the liquid from the third line of nozzle, to eject the liquid to an area between the ends of the image region and the alternate image regions at which a bleeding of the first ink and the second ink can hardly result.

According to the recording apparatus and the recording method of the invention, the image region of a first ink is situated between the other image regions of a second ink; the recording head is controlled and driven so that the ends of the liquid ejection region are located with almost the same interval as the end-to-end interval of the image region of the first ink, and are shifted to a plurality of locations; a plurality of timings for ejecting the liquid corresponding to a plurality of locations are stored in a memory device; of these timings an optimum one is selected and input according to the result of recording and then the liquid is ejected. With this recording apparatus and a recording method, even when plain paper is used as the recording medium, the ejection positions of the liquid and the first and the second inks can easily be adjusted so that the liquid is ejected at the optimum timing at those positions in a boundary area between the ends of the image region of the first ink and the other image regions of the second ink which do not result in bleeding of the first and the second inks.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

First Embodiment

Figure 1:
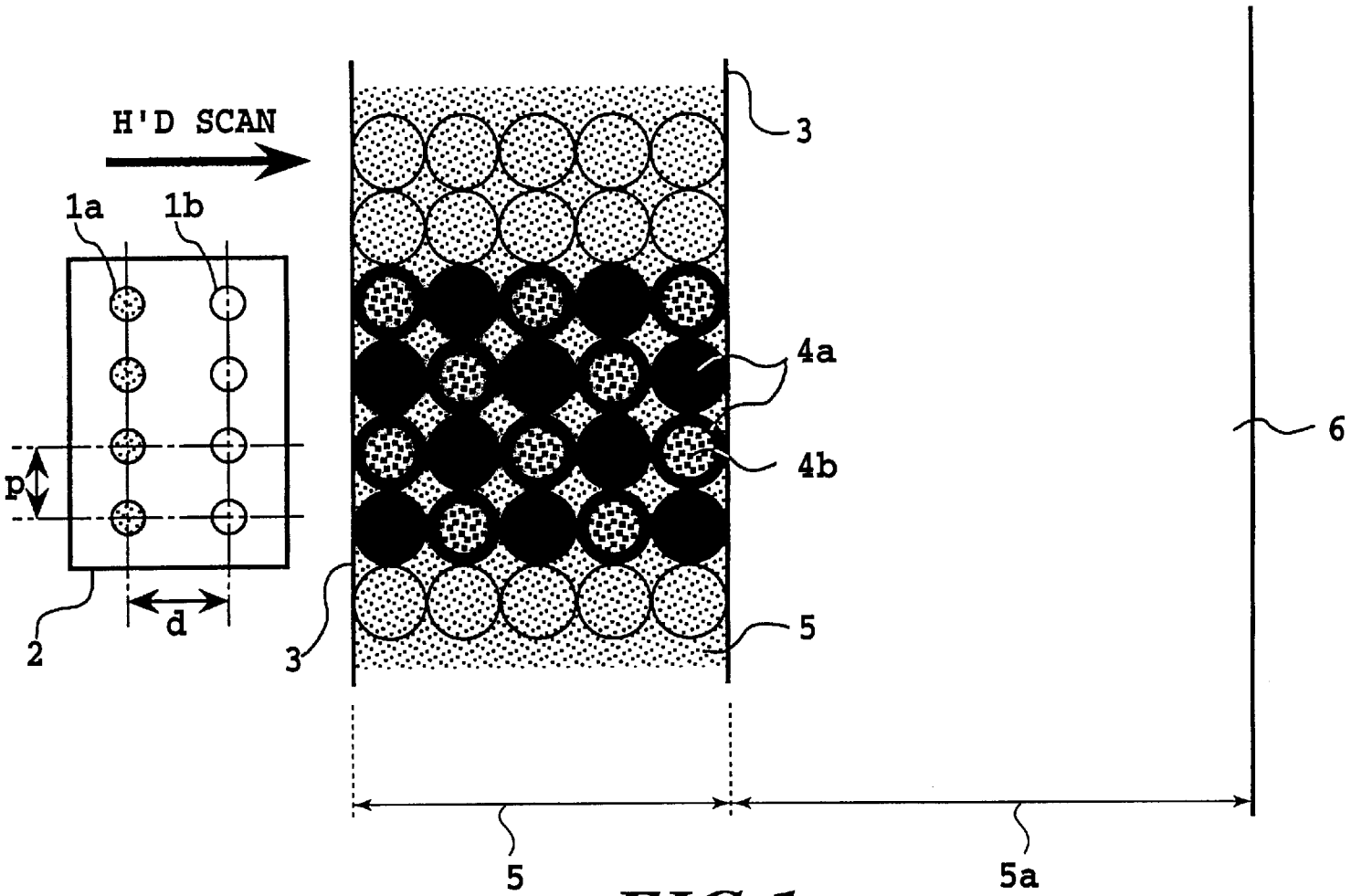
FIG.1 PRIOR ART
FIG. 1 is an explanatory view showing the outline of how an ink and a processing liquid are ejected in a prior art.
Figure 2:
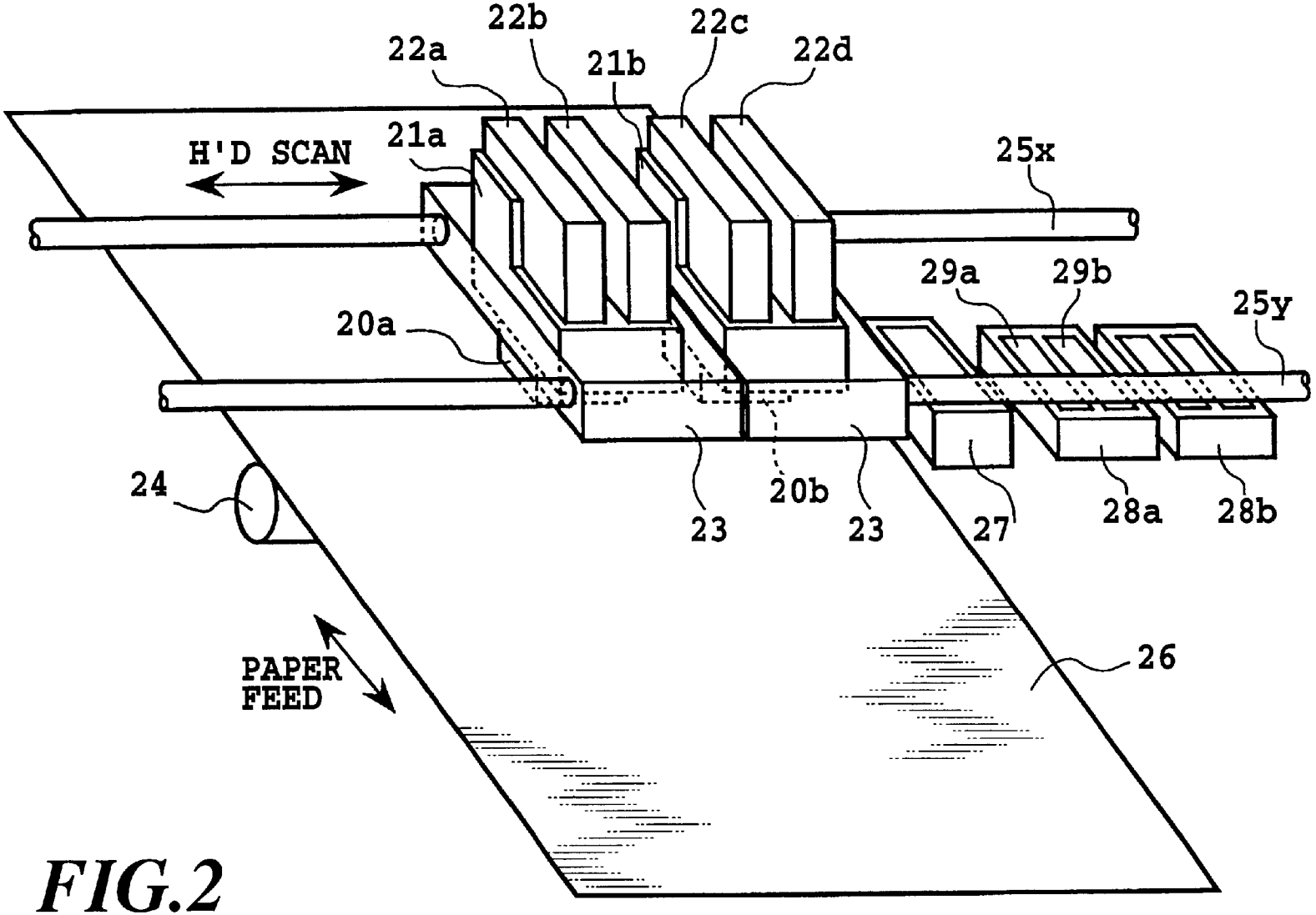
FIG. 2 is a schematic perspective view showing an essential construction of a printer to which the invention can be applied.

FIG. 2 is a schematic perspective view showing a main structure of a printer that can apply the present invention.

FIG. 2 shows the construction of a recording section of one embodiment of an ink-jet printer according to the invention.

Referring to FIG. 2, a head cartridge 21*a* has an ink-jet recording head 20*a* mounting ink tanks 22*a*, 22*b*. A head cartridge 21*b* has an ink-jet recording head 20*b* mounting ink tanks 22*c*, 22*d*. A carriages 23 carrying these ink tanks are driven by a motor described later and guided by guide shafts 25*x*, 25*y* to move in the head-scanning direction indicated by a two-way arrow in FIG. 2. As the carriages 23 moves, the recording heads 20*a*, 20*b* perform scanning for print. Each of the ink tanks has a space therein to store an ink and a processing liquid to be ejected.

Nozzles (not shown) of the ink-jet recording heads 20*a*, 20*b* are each supplied with the processing liquid from the ink tank 22*a* and with color inks from the ink tanks 22*b*, 22*c*, 22*d*. Orifices of the nozzles are in-line arranged in almost the same direction as the paper feeding direction, i.e., in a direction almost perpendicular to the scanning direction of the recording heads. Electricity-heat conversion elements (or heaters) provided one for each liquid-flow-path of the nozzle are supplied with drive signals to apply thermal energy to the inks and the processing liquid. The thermal energy generates bubbles in each liquid, the pressure of which causes each liquid to be expelled. That is, a so-called bubble jet system is used in ejecting the liquids.

The motor described later rotates a feed roller 24 to feed the paper 26 in the paper feeding direction as indicated by a two-way arrow in FIG. 2.

As described above, the two kinds of operations are alternately repeated to print on the entire surface of the paper 26, i.e., a head scanning(main-scanning) operation which ejects the processing liquid or ink from each line of nozzle as the carriages 23 are moved in the head-scanning direction and feeding operation (sub-scanning) of the paper 26 by the feed roller 24.

Caps 28*a*, 28*b* made of an elastic material such as a rubber are located opposing to the orifice-formed surfaces of the recording heads 20*a*, 20*b*, at home position. The caps 28*a*, 28*b* are supported so that they can be brought into or out of engagement with the recording heads 20*a*, 20*b*. The caps 28*a*, 28*b* are used for protecting the recording heads when not recording, for removing the adhering set-up processing liquid or ink, for removing bubbles in the nozzles and ink tanks (spaces in the recording heads to store inks to be ejected), and for forcibly drawing by suction and discharging the inks by a suction pump (not shown).

Because this embodiment uses the head for ejecting the processing liquid and the other head for ejecting the ink, the cap 28*a* is divided into a processing liquid suction portion 29*a* and an ink suction portion 29*b* to draw these liquids by suction individually for recovering their ejecting operation. The above capping structure is employed to remove the adhering processing liquid and ink that have solidified upon mixing and are difficult to remove.

An ink discharge port 27 is provided for recovering the ejecting operation during the ink ejecting operation recovering process. The ejecting operation recovering process is a process which involves holding the orifice-formed surface opposed to the ink discharge port 27 and discharging ink from each line of nozzle of the recording heads to forcibly discharge, into the ink discharge port 27, those inks that are no longer appropriate for use in recording because of bubbles, dust and increased viscosity.

Figure 3B:
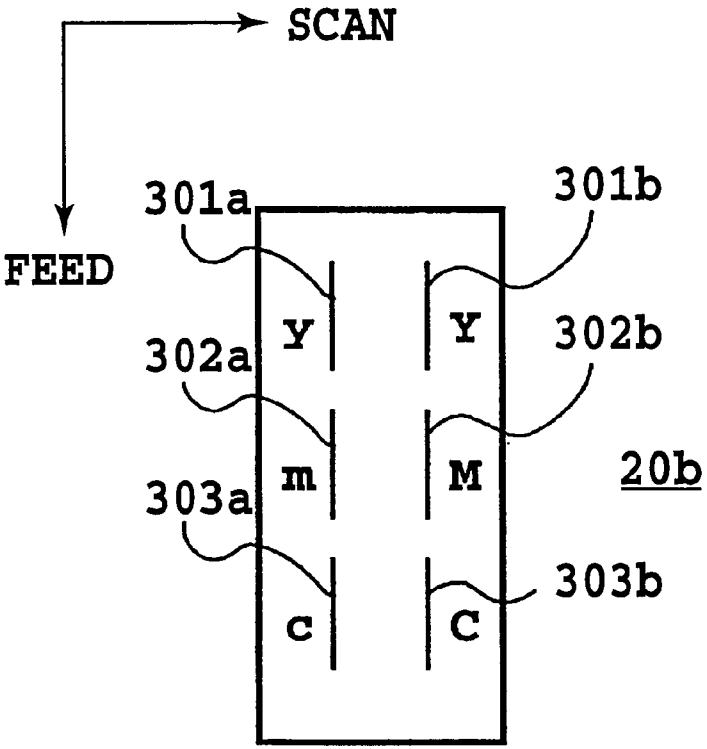
FIGS. 3A and 3B are schematic views showing the recording head portion of a first embodiment of the invention, as seen from the bottom.
Figure 3A:
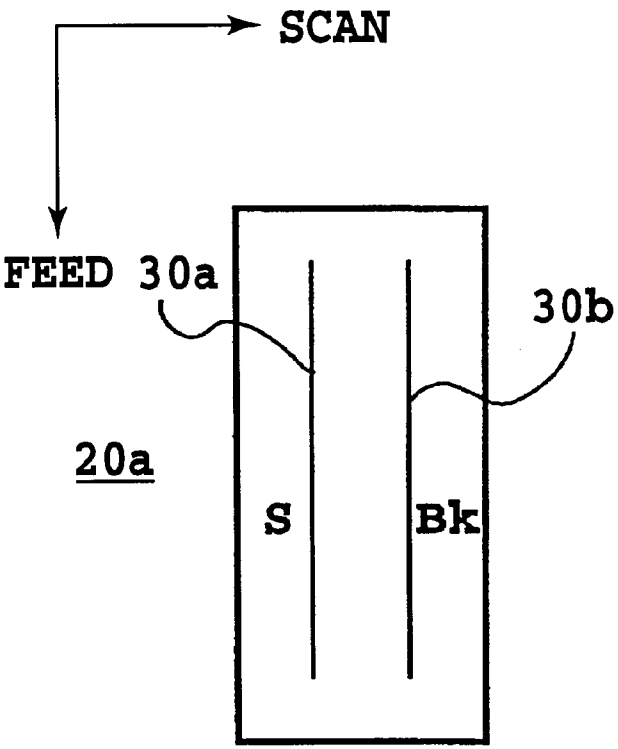

FIGS. 3A and 3B are schematic views of the recording head as seen from the bottom. FIG. 3A shows the bottom of the recording head 20*a* and FIG. 3B shows the bottom of the recording head 20*b*.

As shown in FIG. 3A, the recording head 20*a* has two lines of nozzle 30*a*, 30*b*, with the line of nozzle 30*a* used for ejecting the processing liquid (S) and the line of nozzle 30*b* for ejecting a black ink (Bk). The recording head 20*b*, as shown in FIG. 3B, has six lines of nozzle 301*a*, 302*a*, 30*a*, 301*b*, 302*b*, 30*b*. The lines of nozzle 301*a*, 302*a*, 30*a* are in-line arranged in nearly the paper feeding direction. The lines of nozzle 301*b*, 302*b*, 30*b* are in-line arranged in nearly the paper feeding direction and almost parallel to the lines of nozzle 301*a*, 302*a*, 30*a*.

The line of nozzle 301*a* can eject a low-density yellow ink (y), the line of nozzle 302*a* a low-density magenta ink (m), and the line of nozzle 30*a* a low-density cyan ink (c). The lines of nozzle 301*b*, 302*b*, 30*b* can eject a high-density yellow ink (Y), a high-density magenta ink (M) and a high-density cyan ink (C), respectively.

With the two recording heads 20*a*, 20*b* of FIGS. 3A and 3B mounted on the carriages 23, a variety of monochromatic images such as documents, color graphics and photographic images and color images can be recorded. While this embodiment has the nozzle arrangement as described above, the invention can also be applied to other nozzle arrangement. For example, the invention can be applied to a head cartridge having one line of nozzle allocated for each color ink, and to another head cartridge having a plurality of lines of nozzle allocated for each color ink.

Figure 4:
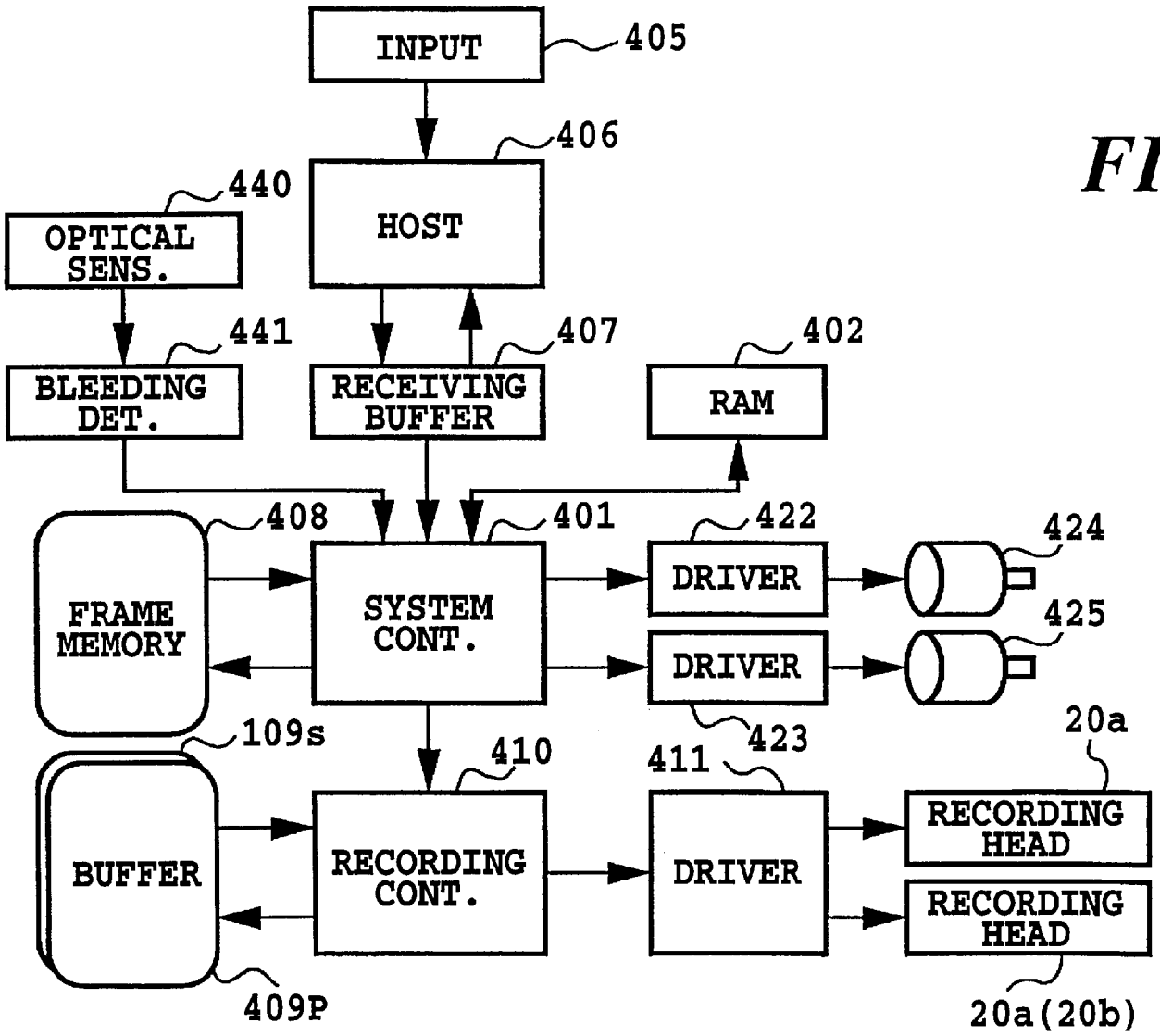
FIG. 4 is a block diagram of a control circuit for the printer of the first embodiment of the invention.

FIG. 4 is a block diagram of a control circuit in the printer of this embodiment.

Included in a system controller 401 are a microprocessor, a read only memory (ROM) storing a printer control program and program codes of the recording method of the invention, and a random access memory (RAM) used for a working area of the microprocessor during processing. The system controller 401 controls the whole apparatus. A motor 424 receives an information from a driver 422, such as a speed and a distance to be traveled, and drives the recording heads in the main-scanning direction (scanning direction). A motor 425 receives an information from a driver 423, such as a speed and a distance to be traveled, and drives the recording medium such as the paper 26 in the sub-scanning direction (paper feeding direction).

A host computer 406 transfers data to be recorded to the printer of this embodiment. The user uses an input device 405 such as a keyboard to enter commands for controlling the printer and data via the host computer 406.

A receiving buffer 407 is a memory device to temporarily store the data from the host computer 406 until commands and data are read into the system controller 401. A frame memory 408 is a memory device used to develop the data to be recorded into image data, and has a memory capacity for recording, for example one page of data. In this embodiment, the capacity of the frame memory 408 is not particularly limited.

Buffers 409S, 409P are memory devices to temporarily store the image data to be recorded and their memory capacity varies depending on the number of nozzles of the recording heads. A recording control section 410 properly controls the operation of the recording heads according to the command from the system controller 401. In more concrete terms, it controls the print speed and the number of print data and also generates ejection timing data of the processing liquid. A driver 411 is controlled by a signal from the recording control section 410 to drive the recording head 20*a* and the recording heads 20*a*, 20*b*. The recording head 20*a* ejects the processing liquid and the recording heads 20*a*, 20*b* eject image recording inks.

The image data is transferred from the host computer 406 to the receiving buffer 407 where it is stored temporarily. Next, the stored image data is read into the system controller 401, which then develops the image data onto the buffers 409S, 409P.

The recording control section 410 generates ejection data based on the image data developed in the buffers 409S, 409P and controls the ejection operation of the recording heads according to the image data and a processing liquid data in the buffers 409S and 409P.

The recording control section 410, under a control of the system controller 401, generates ink ejection data for ejecting a high-density ink and a low-density ink in a predetermined pattern and also generates the processing liquid data for ejecting the processing liquid with the same interval as the end-to-end interval of the high-density ink pattern. When the optimum ejection timing is set according to the landing position adjusting pattern described later, the recording control section 410 controls the ejection operation of the recording heads according to the set ejection timing.

A RAM 402 stores the processing liquid data for the landing position adjusting pattern (a plurality of ejection timing data). According to a command entered from the user's input device 405, the system controller 401 retrieves optimum data among a plurality of ejection timing data stored in the RAM 402 and then sets the timing for ejecting the processing liquid according to the timing retrieved.

Figure 5:
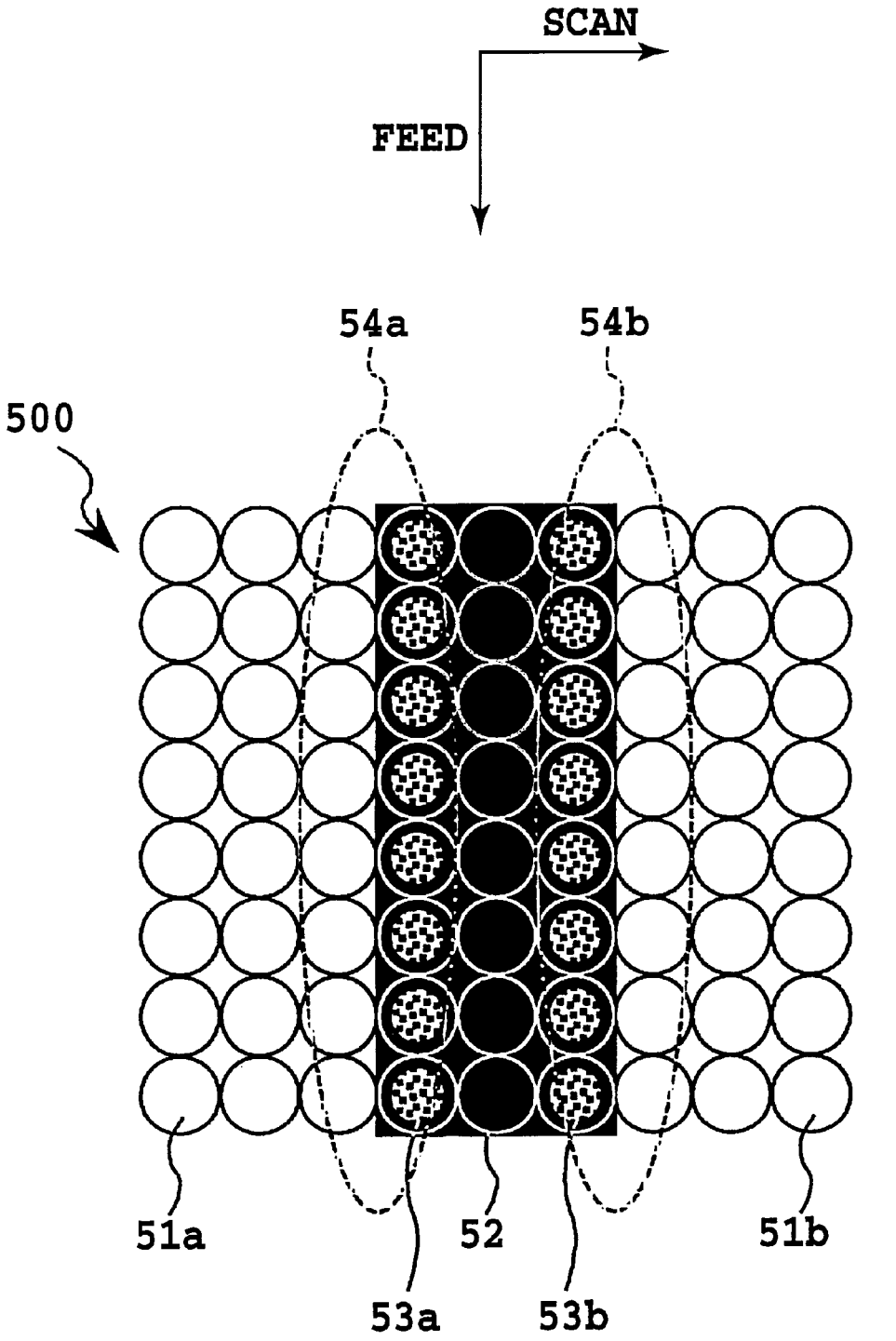
FIG. 5 is an explanatory view showing a landing position adjusting pattern of an ink and a processing liquid in the first embodiment of the invention.

FIG. 5 is an explanatory view showing the landing position adjusting pattern of inks and processing liquid in the first embodiment of the invention.

In FIG. 5, white circles 51*a*, 51*b* represent a low-density ink (in this case yellow) dot pattern (image region), and a black square 52 represent a high-density ink (in this case black) dot pattern (image region), and hatched circles 53*a*, 53*b* represent a dot pattern (ejection region) for the processing liquid. The processing liquid is transparent and colorless and cannot actually be seen as illustrated in FIG. 5. A landing position adjusting pattern 500 comprises patterns of two kinds of ink (yellow and black) and is a solid patched pattern having three regions—a low-density ink image region, a high-density ink image region and a low-density ink image region, arranged in the described order. The distance between the dot pattern 53*a* and the dot pattern 53*b* of the processing liquid is almost equal to the end-to-end distance of the black ink dot pattern 52, so that the processing liquid can be ejected onto boundary areas 54*a*, 54*b* between the black ink dot pattern 52 and the yellow ink dot patterns 51*a* and 51*b*. Based on the images in this boundary areas 54*a*, 54*b*, it can be decided whether or not the landing positions of the processing liquid are correctly aligned.

For a landing position adjustment of the processing liquid to be performed, the landing positions of the black dot pattern 52 and the yellow dot patterns 51*a*, 51*b* need to be adjusted so that the black dot pattern 52 is disposed between and close to the yellow dot patterns 51*a*, 51*b*. These dot patterns are both made of the inks, so that their patterns can be adjusted as described above, using a conventional method, as by actually recording them on plain paper. In this embodiment, the landing positions are adjusted so that the black dot pattern 52 is located between the yellow dot patterns 51*a* and 51*b* in the main-scanning direction.

In this embodiment, when making the pattern shown in FIG. 5, the processing liquid is also ejected onto a plurality of locations shifted its landing positions in the boundary areas 54*a*, 54*b*, between two image regions toward the both ends of the high-density ink dot region (the black dot pattern 52) to perform the landing position adjustment for the inks and the processing liquid.

Figure 6B:
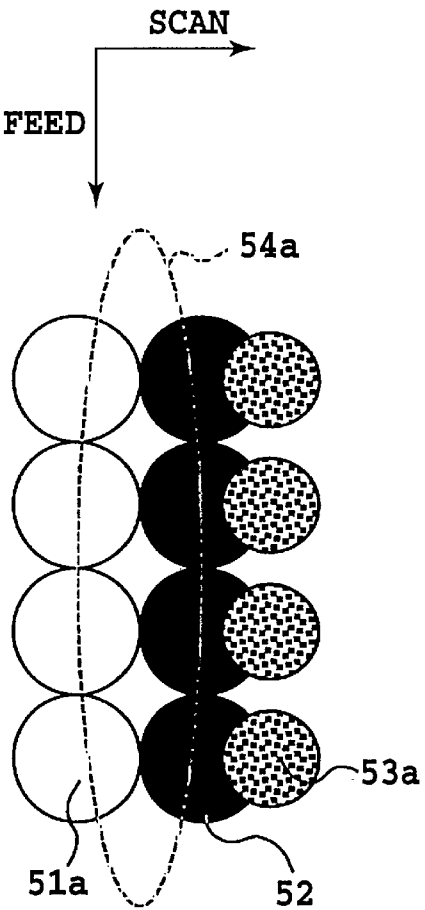
FIGS. 6A and 6B are explanatory views showing a method of adjusting the landing; positions of the ink and the processing liquid according to the result of ejection operation in the first embodiment of the invention.
Figure 6A:
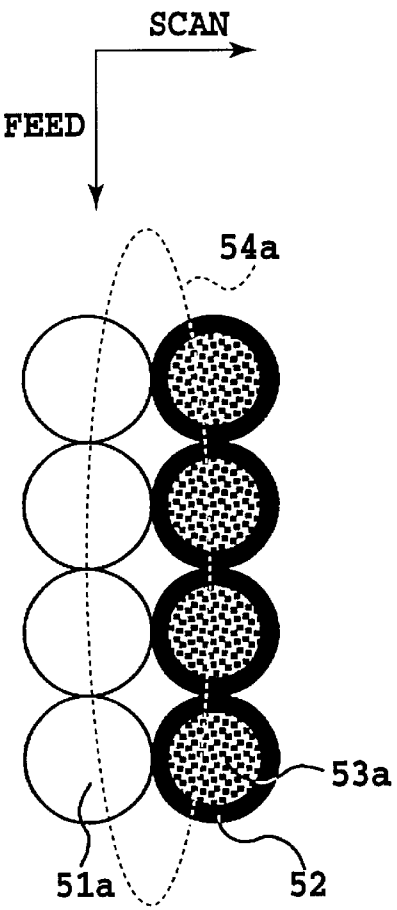

FIGS. 6A and 6B are explanatory views showing the method of adjusting the landing positions of the inks and the processing liquid according to the result of ejection operation described above. Both figures show enlarged views of the left-side boundary area 54*a* of FIG. 5.

The boundary area 54*a* is applied with the processing liquid and if the landing positions of the processing liquid dots 5*a* agree with the left-end dot positions of the black dot pattern 52, as shown in FIG. 6A, the two dot patterns 51*a* and 52 do not spread or bleed, clearly showing the boundary area 54*a*.

When, however, the landing positions of the processing liquid dots 5*a* and the landing positions of the black dot pattern 52 do not agree, as shown in FIG. 6B, the black dot pattern 52 spreads or bleeds into the region of the yellow dot pattern 51*a* in the boundary area 54*a*, degrading the recorded image quality. The bleeding in the left-end boundary area 54*a* indicates that the dot pattern 5*a* of the processing liquid is deviated rightward from the landing positions of the black dot pattern 52 in the boundary area 54*a*.

FIG. 6B shows an illustration where the processing liquid is shifted toward the right. When the processing liquid dots are deviated to the left end, the alignment/misalignment (agreement/disagreement) of the landing positions can be determined by inspecting if there is any bleeding in the boundary area 54*b* on the other end (right-end), or at the opposite end, of the black dot pattern 52.

FIGS. 5, 6A and 6B show printed(recorded) patterns when the landing position adjustment is performed in the left-to-right direction (in the main-scanning direction). The adjustment of landing positions in the sub-scanning direction can be accomplished by recording similar patterns which are simply shifted 90 degrees from the patterns shown in FIG. 5. Both of the above two patterns may be defined as a print pattern for making the landing position adjustment in the main-scanning direction and in the sub-scanning direction.

FIGS. 7A through 7E are explanatory views showing an example of actual adjustment performed by using the above landing position adjusting pattern.

In FIGS. 7A through 7E, reference numerals 71*a* and 71*b* represent yellow dot patterns, and 73 represents a black dot pattern. A white square frame designated as 72 represents a dot pattern of the processing liquid. By adjusting the timing of ejecting the processing liquid so as to shift the dot pattern 72 to a plurality of locations, as shown in FIGS. 7A through 7E, it is possible to print several landing position adjusting patterns 701, 702, 703, 704, 705 with different processing liquid landing positions, in the same manner as the landing position adjusting pattern shown in FIG. 5.

Figures 7A, 7B, 7C, 7D, 7E:
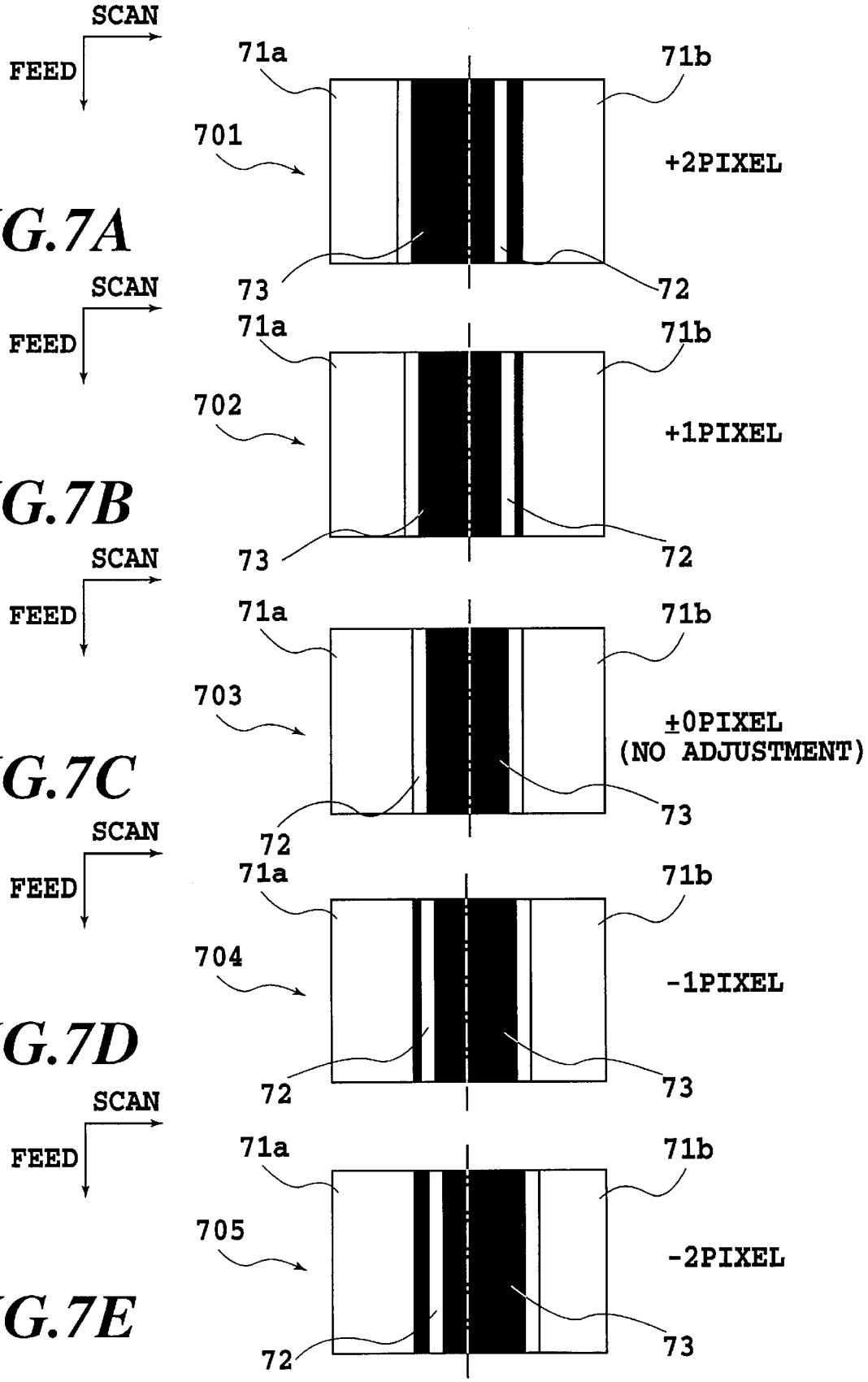
FIGS. 7A through 7E are explanatory views showing an example of actual adjustment using the landing position adjusting pattern in the first embodiment of the invention.

The processing liquid dot pattern 72 is shifted leftward by two pixels in the landing position adjusting pattern 701 of FIG. 7A and by one pixel in the landing position adjusting pattern 702 of FIG. 7B. The processing liquid dot pattern 72 is shifted rightward by one pixel in the landing position adjusting pattern 704 of FIG. 7D and by two pixels in the landing position adjusting pattern 705 of FIG. 7E. In the landing position adjusting pattern 703 of FIG. 7C, the dot pattern 72 is not shifted in any direction and there is no need for further adjustment.

The user, after inspecting the recorded results of the landing position adjusting patterns 701–705, picks up one of the patterns, with the least bleeding in the boundary areas between the black dot pattern 72 and the yellow dot patterns 71*a*, 71*b* (in the examples shown, the adjusting pattern 703), and stores the optimum processing liquid ejection timing into the RAM 402 of the printer, that has resulted in the least bleeding. Then, normally based on this ejection timing, the recording control section 410 sets the ejection timing, thus optimally adjusting the landing positions of the inks and the processing liquid anytime.

As described above, this embodiment allows the user to adjust the landing positions of the transparent processing liquid according to the degree of spreading of the two inks in a printed pattern by actually inspecting the recorded results of black and yellow ink dots ejected close to each other. Therefore, the landing positions of the recording liquids and the processing liquid can be made to agree with each other easily and precisely, even when plain paper is used. Further, the positional precisions required of the line of nozzle for recording liquid and the line of nozzle for processing liquid can be lowered, facilitating the manufacture of the recording heads and lowering the cost of manufacture.

Further, because the two kinds of ink, black and yellow, used in the landing position adjusting pattern have different densities, any bleeding between the two inks in the adjusting pattern clearly shows, facilitating the landing position adjustment.

As described above, because the landing position adjusting pattern is recorded in such a manner that a high-density ink pattern is disposed between and close to low-density ink patterns and that the processing liquid overlies a part of the high-density ink pattern in the boundary area of the two different patterns, the adjustment of the landing positions in both directions can be performed easily.

Further, because the user picks up and sets one optimum pattern with the least bleeding of the landing position adjusting patterns after inspected the shiftingly recorded results of the landing position adjusting patterns, when the user is required to use the processing liquid, i.e., when improvements should be made in terms of color development, water resistance and bleeding, the landing position adjustment can be done efficiently and easily with a high degree of freedom.

Further Embodiment

While the above embodiment concerns an illustration where the user inspects the actually recorded images and picks up one with the least bleeding, the image bleeding on the paper may be detected by a configuration in this embodiment, with additional components 440, 441 shown in FIG. 4.

An optical sensor 440 includes a CCD or the like integrally mounted on the carriages 23 and c detect an image on the paper. An image signal from the optical sensor 440 is entered into a bleeding detector 441 to undergo a predetermined processing by which a bleeding of the image in the landing position adjusting pattern can be detected. The system controller 401 sets the ejection timing for the recording control section 410 to eject the processing liquid at the timing that corresponds to the pattern with the minimum bleeding.

This embodiment can produce the similar effect to that of the first embodiment efficiently without troubling the user.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink-jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink-jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink-jet recording apparatus of the present invention can be employed not only as an image output terminal of an information processing device such as a computer, but also as an output device of a copying machine including a reader, and as an output device of a facsimile apparatus having a transmission and receiving function.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 mm in pore size (tradename: fuloropore filter manufactured by Sumitomo Electric Industries, Ltd.), and thereafter, pH of the mixture is adjusted to a level of 4.8 by adding sodium hydroxide whereby liquid Al can be obtained.

[components of A1]

low molecular weight ingredients of cationic compound; stearyl-trimethyl ammonium salts (tradename: Electrostriper QE, manufactured by Kao Corporation), or stearyl-trimethyl ammonium chloride (tradename: Yutamine 86P, manufactured by Kao Corporation) 2.0 parts by weight high molecular weight ingredients of cationic compound; copolymer of diarylamine hydrochloride and sulfur dioxide(having an average molecular weight of 5000)

(tradename: polyaminesulfon PAS-92, manufactured by Nitto Boseki Co., Ltd.) 3.0 parts by weight thiodiglycol; 10 parts by weight water balance Preferable examples of ink which becomes insoluble by mixing the aforementioned processing liquid can be noted below.

Specifically, the following components are mixed together, the resultant mixture is pressure-filtered with the use of a membrane filter of 0.22 mm in pore size (tradename; Fuloroporefilter, manufactured by Sumitomo Electric Industries, Ltd.) so that yellow ink Y1, magenta ink M1, cyan ink C1 and black ink K1 can be obtained.

[Yellow ink Y1]

C. I. direct yellow 142 2 parts by weight thiodiglycol 10 parts by weight acetynol EH (tradename manufactured by Kawaken Fine Chemical Co., Ltd.) 0.05 parts by weight water balance

[Magenta ink M1]

having the same composition as that of Y1 other than that the dyestuff is changed to 2.5 parts by weight of C. I. acid red 289.

[Cyan ink C1]

having the same composition as that of Y1 other than that the dyestuff is changed to 2.5 parts by weight of acid blue 9.

[Black ink K1]

having the same composition as that of Y1 other than that the dyestuff is changed to 3 parts by weight of C. I. food black 2.

According to the present invention, the aforementioned processing liquid and ink are mixed with each other at the position on the recording medium or at the position where they penetrate in the recording medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the recorded material. As a result, only the liquid portion separated from the solid portion permeates into the recorded paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and the second stages.

When the present invention is carried out, since there is no need of using the cationic material having a high molecular weight and polyvalent metallic salts like the prior art or even though there is need of using them, it is sufficient that they are assistantly used to improve an effect of the present invention, a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

With respect to a recording medium usable for carrying out the present invention, there is no specific restriction, so called plain paper such as copying paper, bond paper or the like conventionally used can preferably be used. Of course, coated paper specially prepared for ink-jet printing and OHP transparent film are preferably used. In addition, ordinary high quality paper and bright coated paper can preferably be used.

Further, the invention may be applied to a system comprising a plurality of recording apparatuses or to a single recording apparatus. The invention can, of course, be applied to an illustration where the invention is realized by supplying a program to a system or recording apparatus. In that case, software stored in a memory medium in the form of a program representing the invention is read into the system or recording apparatus, which then can utilize the advantages of the invention.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recording apparatus comprising:

a recording head having a first line of nozzles for ejecting a first ink, a second line of nozzles for ejecting a second ink and a third line of nozzles for ejecting a liquid that reacts with the first and second inks, the first, second and third lines of nozzles being arranged in substantially the same direction;

a scanning means for moving the recording head in a predetermined direction, different from the direction of the first, second, and third lines of nozzles to scan over a recording medium;

a feeding means for feeding the recording medium in a direction substantially perpendicular to the direction of the recording head;

a recording means for driving the recording head, to form an image on the recording medium, under a control of an ink ejection control means and a liquid ejection control means, the ink ejection control means controls ejection timings of the inks from the first and second lines of nozzles at predetermined timings so that an image region formed of the first ink on the recording medium is disposed between alternate image regions formed of the second ink, the liquid ejection control means controls ejection timings of the liquid from the third line of nozzles at predetermined timings so that ends of a ejection region of the liquid are located within substantially the same interval as an end-to-end interval of the image region and that the ejection region is shifted to a plurality of locations;

a memory means for storing a plurality of ejection timings of the liquid that correspond to the plurality of locations; and a setting means for setting the ejection timing of the liquid optimum, by entering some of the plurality of ejection timings to eject the liquid from the third line of nozzles, to eject the liquid to an area between the ends of the image region and the alternate image regions at which a bleeding of the first ink and the second ink can hardly result.

2. A recording apparatus as claimed in claim 1, wherein the recording means divides the alternate image regions of the second ink into a plurality of regions in the predetermined direction and the image region of the first ink is located between the divided image regions.

3. A recording apparatus as claimed in claim 1, wherein the recording means divides the alternate image regions of the second ink into a plurality of regions in the perpendicular direction and the image region of the first ink is located between the divided image regions.

4. A recording apparatus as claimed in claim 1, wherein the setting means comprises:

an input means used by a user for inputting the optimum ejection timing; and a read means for reading out from the memory means an ejection timing corresponding to the input optimum ejection timing.

5. A recording apparatus as claimed in claim 1, wherein the setting means comprises:

an image detection means for detecting a recorded image on the recording medium, formed by the recording means;

a detection means for detecting bleeding of the first ink and the second ink at the plurality of locations on the recorded image between the image region and the alternate image regions;

an input means for inputting, according to a detection result by the detection means, the optimum ejection timing when the detected bleeding is minimum; and a read means for reading out from the memory means an ejection timing corresponding to the input optimum timing.

6. A recording apparatus as claimed in claim 1, wherein the first line of nozzles ejects the first ink of a higher density than the second ink, and the third line of nozzles ejects the liquid to improve the recorded image of the first and second inks.

7. A recording apparatus as claimed in claim 1, wherein the liquid contains a component that makes the coloring agents in the first and second ink insoluble or causes them to aggregate.

8. A recording apparatus as claimed in any one of claims 1 through 7, wherein the recording head has electricity-heat conversion elements in liquid flow paths of the first to third lines of nozzles and the electricity-heat conversion elements expel the first and second inks and the liquid by thermal energy they produce.

9. A recording method in a recording apparatus provided with a recording head having a first line of nozzles for ejecting a first ink, a second line of nozzles for ejecting a second ink and a third line of nozzles for ejecting a liquid that reacts with the first and second inks, the first, second and third lines of nozzles being arranged in substantially the same direction; a scanning means for moving the recording head in a predetermined direction different from the direction of the first, second and third lines of nozzles to scan over a recording medium; a feeding means for feeding the recording medium in a direction substantially perpendicular to the predetermined direction of the recording head said recording method comprising the following steps:

a recording step of driving the recording head to form an image on the recording medium under a control of an ink ejection control means and a control of a liquid ejection control means, the ink ejection control means controls ejection timings of the inks from the first and second lines of nozzles at predetermined timings so that an image region formed of the first ink on the recording medium is disposed between alternate image regions formed of the second ink, the liquid ejection control means controls the ejection timings of the liquid from the third line of nozzles at predetermined timings so that ends of a ejection region of the liquid are located at substantially the same interval as an end-to-end interval of the image region and that the ejection region is shifted to a plurality of locations;

a memory step of storing a plurality of ejection timings of the liquid in a memory device, that correspond to the plurality of locations; and a setting step of setting ejection timing of the liquid optimum, by entering some of the plurality of ejection timings to eject the liquid from the third line of nozzles, to eject the liquid to an area between the ends of the image region and the alternate image regions at which a bleeding of the first ink and the second ink can hardly result.

10. A recording method as claimed in claim 9, wherein the recording step comprises:

dividing the alternate image regions of the second ink into a plurality of regions in the predetermined direction, and the image region of the first ink being located between the divided image regions.

11. A recording method as claimed in claim 9, wherein the recording step comprises:

dividing the alternate image regions of the second ink into a plurality of regions in the perpendicular direction, and said image region of the first ink being located between the divided image regions.

12. A recording method as claimed in claim 9, wherein the setting step comprises:

an input step used by a user for inputting the optimum ejection timing, and a read step of reading out from the memory device an ejection timing corresponding to the input optimum ejection timing.

13. A recording method as claimed in claim 9, wherein the setting step comprises:

an image detection step of detecting a recorded image on the recording medium, formed at the recording step;

a detection step of detecting bleeding of the first ink and the second ink at the plurality of locations on the recorded image between the image region and the alternate image regions;

an input step of inputting, according to a detection result at the detection step, the optimum ejection timing when the detected bleeding is minimum; and a read step of reading out from the memory device an ejection timing corresponding to the input optimum timing.

14. A recording method as claimed in claim 9, wherein the recording step comprises:

ejecting, from the first line of nozzles, the first ink of a higher density than the second ink, and ejecting, from the third line of nozzles, the liquid to improve the recorded image of the first and second inks.

15. A recording method as claimed in claim 9, wherein the liquid contains a component that makes coloring agents in the first and second ink insoluble or causes them to aggregate.

16. A recording method as claimed in any of one of claims 9 through 15, wherein the recording head has electricity-heat conversion elements in liquid flow paths of the first to third lines of nozzles, and the recording step comprising the electricity-heat conversion elements expelling the first and second inks and the liquid by thermal energy they produce.

17. A forming method of forming a landing position adjusting pattern for a liquid, said method being implemented with a recording apparatus which performs recording using a recording head provided with a first line of nozzles for ejecting a first ink, a second line of nozzles for ejecting a second ink, and a third line of nozzles for ejecting the liquid, the liquid being reactive with the first ink and the second ink; said method comprising the steps of:

forming a first image pattern of the first ink, forming a liquid pattern of the liquid overlapping with an end of the first image pattern; and forming a second image pattern of the second ink located close to the first image pattern.

18. A forming method as claimed in claim 17, wherein a plurality of liquid patterns of the liquid are formed at different locations in said liquid pattern forming step.

19. A forming method as claimed in claim 18, further comprising the step of a user selecting one liquid pattern from a plurality of liquid patterns.

20. A forming method as claimed in claim 18, further comprising the step of selecting, from a plurality of liquid patterns, a liquid pattern which does not bleed at a boundary of the first ink and the second ink.

21. A forming method as claimed in claim 18, further comprising the step of selecting, from a plurality of liquid patterns, a liquid pattern in dependence upon bleeding degree at a boundary of the first ink and the second ink.

22. A forming method as claimed in claim 17, wherein the liquid contains a component which makes coloring agents in the first ink and the second ink insoluble or causes those coloring agents to aggregate.

23. A forming method as claimed in claim 17, wherein the liquid is transparent.

* * * * *

UNITED STATES PATENT AND TRADEMARK OFFICE

CERTIFICATE OF CORRECTION

PATENT NO. : 6,371,609 B1
DATED : April 16, 2002
INVENTOR(S) : Masaki Oikawa

It is certified that error appears in the above-identified patent and that said Letters Patent is hereby corrected as shown below:

Title page,
Item [56], FOREIGN PATENT DOCUMENTS, "59123670" should read -- 59-123670 --; insert -- EP 0 798 120 10/1997 --; and insert -- EP 0 726 159 8/1996 --.

Column 3,
Line 15, "forming" should read -- form --; and
Line 63, "a" should read -- an --.

Column 5,
Line 13, "landing;" should read -- landing --;
Line 33, "A" should read -- The --; and
Line 37, "moves," should read -- move, --.

Column 6,
Line 33, "30a," should read -- 303a, --;
Line 34, "30b." should read -- 303b. --; and "30a" should read -- 303a --;
Line 36, "30b" should read -- 303b --;
Line 38, "30a." should read -- 303a. --;
Line 41, "30a" should read -- 303a --;
Line 42, "30b" should read -- 303b --; and
Line 51, "ment." should read -- ments. --.

Column 8,
Line 26, "shifted its landing positions" should be deleted;
Line 38, "5a" should read -- 53a --;
Line 43, "5a" should read -- 53a --; and
Line 48, "5a" shodul read -- 53a --.

Column 9,
Line 63, "inspected" should read -- inspecting --.

UNITED STATES PATENT AND TRADEMARK OFFICE

CERTIFICATE OF CORRECTION

PATENT NO. : 6,371,609 B1
DATED : April 16, 2002
INVENTOR(S) : Masaki Oikawa

It is certified that error appears in the above-identified patent and that said Letters Patent is hereby corrected as shown below:

Column 10,
Line 12, “c” should read -- can --.

Column 14,
Line 31, “a” should read -- an --.

Signed and Sealed this

Seventeenth Day of September, 2002

*Attest:*

*Attesting Officer*

JAMES E. ROGAN
*Director of the United States Patent and Trademark Office*